US005750017A

United States Patent [19]

Zhang

[11] Patent Number: 5,750,017

[45] Date of Patent: May 12, 1998

[54] TIN ELECTROPLATING PROCESS

[75] Inventor: Yun Zhang, Berkeley Heights, N.J.

[73] Assignee: Lucent Technologies Inc., Murray Hill, N.J.

[21] Appl. No.: 697,150

[22] Filed: Aug. 21, 1996

[51] Int. Cl.[6] ..... C25D 5/18

[52] U.S. Cl. ..... 205/102; 205/104; 205/254; 205/302; 205/303

[58] Field of Search ..... 205/104, 253, 205/254, 302, 303, 304, 102, 103; 204/DIG. 19

[56] References Cited

U.S. PATENT DOCUMENTS

| | | | |
|---|---|---|---|
| 3,634,212 | 1/1972 | Valayil et al. | 205/104 |
| 4,263,106 | 4/1981 | Kohl | 204/43 |
| 4,923,576 | 5/1990 | Kroll et al. | 205/253 |
| 5,066,367 | 11/1991 | Nobel et al. | 205/254 |
| 5,110,423 | 5/1992 | Little et al. | 205/304 |

FOREIGN PATENT DOCUMENTS

| | | |
|---|---|---|
| Sho 59-473-95 | 3/1984 | Japan . |
| Sho 61-194196 | 8/1986 | Japan . |
| Hei 5-49760 | 7/1993 | Japan . |

OTHER PUBLICATIONS

"An Alternative Surface Finish for Tin/Lead Solders—Pure Tin", by Zhang, Y. and Abys, J., *SUR-FIN '96 International Technical Conference Proceedings,* Cleveland, Ohio, pp. 223–245 (Jun. 10, 1996).

"An Overview of Pulse Plating", by Osero, N. M., *Plating and Surface Finishing,* (Mar. 1986).

"Tin Whiskers: A Case Study", by McDowell, M. E. Captain, USAF, Los Angeles Air Force Base, pp. 207–215, no date available.

"Microstructural Characterization of Electrodeposited Tin Layer", by Selcuker, A. et al., Vitramon, Inc. Box 544, Bridgeport, CT., pp. 19–22, no date available.

"Hot Air Leveled Tin: Solderability and Some Related Properties", by Haimovich, J., *1989 Proceedings for 39th Electronic Components Conference,* pp. 107–112 (May 1989).

"Grain Size Effect of Electro-Plated Tin Coatings on Whisker Growth", by Kakeshita, T. et al., *Journal of Materials Science* 17 pp. 2560–2566 (1982). (no month available).

*Primary Examiner*—Arun S. Phasge
*Assistant Examiner*—Kishor Mayekar
*Attorney, Agent, or Firm*—Richard J. Botos

[57] ABSTRACT

A process for plating tin or tin alloy onto metal substrates is described. In the process, a metal substrate is placed in an electroplating bath that contains a stannous sulfate and an organic compound additive in which the organic compound has a heterocyclic moiety in an aqueous solution of sulfonic acid. The bath is then subjected to pulse plating conditions that plate a layer of tin or tin alloy onto the metal substrate wherein the tin in the tin layer has a grain size of about 2 μm to about 8 μm. During pulse plating, a current density of about 65 ASF to about 250 ASF is applied to the electroplating bath in a pulsed manner, i.e. the current is cycled on and off during plating. The duty cycle of the pulse is about twenty-five percent to about thirty percent. The duration of the on pulse during the cycle is about 50 μs to about 500 μs.

10 Claims, 3 Drawing Sheets

TIN ELECTROPLATING PROCESS

BACKGROUND OF THE INVENTION

1. Technical Field

The process of the present invention is directed to a process for electroplating tin on metal substrates.

2. Art Background

Tin is known as a metal which has excellent corrosion resistance. Good soldered connections are formed on tin surfaces because an excellent bond forms between the tin and the solder. Furthermore, when tin is plated on metals such as steel, copper, aluminum, nickel, and alloys thereof, the tin plate provides corrosion resistance and solderability to these metal substrates. Tin plate coatings are typically soft and ductile. One disadvantage of tin plate is the tendency of tin to grow crystalline "whiskers." Although the cause of whisker growth has been the subject of some debate, there is no question that whiskers are undesirable for a variety of electrical, mechanical, and cosmetic reasons.

Typically, tin is plated on metal substrates using an electrodeposition process. Although the exact cause of whisker growth has not been determined, it has been observed that whisker growth is affected by a variety of parameters in the electrodeposition process such as the current density, plating thickness, tin purity, and temperature. The pressure and external stress to which the plated substrate will be subjected also influences the selection of the plating process parameters.

Selucker, A., et al., "Microstructural Characterization of Electrodeposited Tin Layer in Relation to Whisker Growth," *CARS-EUROPE'* 90 p. xiv+280 (1990) associates whisker growth with the microstructural details, i.e., the grain size and shape, of the tin. Grains are the individual metal crystals in the metal. Selucker et al. postulates that whisker growth is suppressed in tin that has a grain size in the range of 1–8 μm, and that whisker growth is especially difficult in metals with a grain size of 1–3 μm. Kakeshita, T., et al., "Grain size effect of electro-plated tin coatings on whisker growth," *Journal of Materials Science* Vol. 17, pp. 2560–2566 (1982) also notes that whisker growth is more difficult on tin plate with a well-polygonized (i.e., regular as opposed to irregular grain boundaries) grain structure. Kakeshita et al. also note that the well-polygonized grains have a grain size of at least 1 micron. Kakeshita et al suggests annealing the tin plate in order to reduce the number of irregularly-shaped grains. However, as noted in Selucker, it is difficult to design a process that plates a metal with a desired microstructure. However, because of the potential benefits (i.e. reduced or eliminated whisker growth) provided by tin plate with a grain size in the above-specified range, a plating process that provides tin plate with the desired grain size is advantageous.

SUMMARY OF THE INVENTION

The invention is a process for electroplating tin and alloys thereof onto metal substrates using an aqueous plating solution. The solution contains a stannous sulfonate that is either stannous alkyl sulfonate or stannous alkoyl sulfonate combined with a sufficient amount of either an alkyl sulfonic acid or an alkoyl sulfonic acid to provide a solution with a pH of about 1 or less. It is advantageous if the concentration of the stannous sulfate in the aqueous-based solution is sufficient to provide a metal concentration of about 20 g/l to about 110 g/l and the concentration of the sulfonic acid is about 100 ml/l to about 250 ml/l based upon the use of a 70% acid solution. The solution also contains at least one organic additive that has at least one heterocyclic moiety and at least one aromatic moiety. Examples of suitable heterocyclic moieties include lactones, cyclic imides, and oxazolines. Examples of suitable aromatic moieties include substituted and unsubstituted phenyl groups and phenol groups. In a preferred embodiment, the heterocyclic moiety and the aromatic moiety are bound together to form a bicyclic, tricyclic or polycyclic moiety. Examples of suitable polycyclic compounds include phenolphthalein and thymolphthalein.

The polycyclic compound is either substituted or unsubstituted. Examples of suitable substituents include hydroxyl groups, amine groups, carboxylic acid groups, aliphatic hydrocarbon chains containing no more than about eight carbon atoms, and aromatic moieties that contain no more than about eight carbon atoms. It is advantageous if the concentration of the organic additive in the solution is about 0.08 g/l to about 0.8 g/l.

In one embodiment of the present invention, the solution contains at least one other organic additive which suppresses the growth of dendrites and ensures smooth, adhesive deposits. Polyalkoxylated alkyl phenol additives are examples of additives that are suitable for this purpose. A specific example of one such additive is octyl phenoxy(10) polyethoxyethanol. Other conventional polyether additives are also contemplated as suitable. In the embodiment of the present invention in which these additives are present, the concentration of these additives in the electroplating solution is about 0.5 g/l to about 4 g/l.

In the present invention, the article to be plated is placed in the above described solution and subjected to pulse plating conditions. Pulse plating conditions are described generally in Osero, N., "An Overview of Pulse Plating," *Plating and Surface Finishing*, Vol. 73, p. 20 (1986), which is hereby incorporated by reference. In the process of the present invention, pulse plating conditions are used that provide tin plate with a grain size of about 2 μm to about 8 μm. Examples of suitable pulse plating conditions are those in which the average current density is varied from about 65 ASF to about 250 ASF in such a manner that the pulse on time is about 50 μs to about 500 μs with a duty cycle of about twenty-five percent to about thirty percent. Duty cycle is defined herein as the ratio of pulse on-time to the sum of pulse on-time and pulse off-time. The average current density is defined as the product of the peak current density and the duty cycle.

The electrodes used to effect the plating are conventional electrodes well known to one skilled in the art. The article to be plated functions as the working electrode in the electroplating bath. The bath is also equipped with a second electrode that functions as the anode in the electroplating bath. Conventional anodes for plating tin and tin alloy are contemplated as suitable. One skilled in the art will recognize that there are many different types of electrodes which are suitable for use in the process of the present invention.

DETAILED DESCRIPTION

Figure 1:
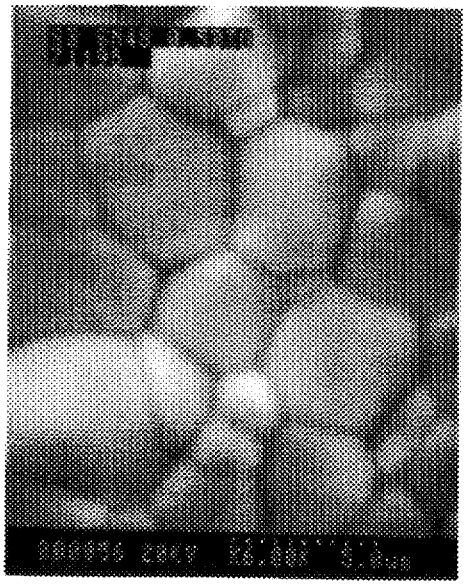
FIG. 1 is a photograph of the microstructure of a tin plate formed by the process of the present invention at 6K magnification.

In the process of the present invention, the previously described plating solution is prepared by adding either stannous alkyl sulfonate or stannous alkoyl sulfonate to an aqueous solution of alkyl sulfonic acid or alkoyl sulfonic acid. If a 1 liter of the solution is being prepared, about 20 g to about 110 g of the stannous sulfonate is added to one liter of an aqueous solution that contains about 100 ml to 250 ml of a 70 percent solution of alkyl or alkoyl sulfonic acid. To this solution is added about 0.08 g/l to about 0.8 g/l of an organic additive that has at least one heterocyclic moiety and one aromatic moiety. Examples of suitable heterocyclic moieties include substituted and unsubstituted lactones, cyclic imides, and oxazolines. Examples of suitable aromatic moieties include substituted and unsubstituted phenyl and phenol moieties. In a preferred embodiment, the heterocyclic moiety and the aromatic moiety are bound together to form a bicyclic, tricyclic or polycyclic moiety.

Examples of suitable substituents include hydroxyl groups, amine groups, carboxylic acid groups, aliphatic hydrocarbon chains containing no more than about eight carbon atoms, and aromatic moieties that contain no more than about eight carbon atoms. Examples of suitable polycyclic compounds include phenolphthalein and thymolphthalein.

In one embodiment of the present invention, about 0.5 g/l to about 4 g/l of a polyalkoxylated alkyl phenol is added to the solution to suppress the growth of dendrites and provide smooth deposits that adhere well to the underlying substrate. It is advantageous if the alkyl group in these compounds has from about 7 to about 10 carbon atoms and the number of alkoxy groups is about 8 to about 12. Octylphenoxy(10) polyethoxy ethanol is one example of a suitable polyether. Other suitable additives for use in the process of the present invention are readily apparent to one skilled in the art.

After the above-described solution is prepared, it is then used to plate tin or tin alloy onto a metal substrate by placing the metal substrate in a plating solution equipped with a conventional electrode used to plate tin or tin alloy onto a metal substrate. The plating solution is maintained at a temperature in the range of about 50° C. to about 60° C. Current is provided to the solution in a pulsed manner to provide plating conditions under which the resulting tin plate has a grain size of about 2 μm to about 8 μm. This is accomplished by plating in a pulsed manner. Examples of suitable plating conditions are conditions under which the average current density is varied from about 65 ASF to about 250 ASF in pulses with a duration of about 50 μs to about 500 μs.

The substrate is maintained in the above-described solution under the above-described conditions for a period of time that is sufficient to plate the substrate with coating of tin of the desired thickness. It is advantageous if the tin plate has a thickness of about 3 μm to about 6 μm. Thicknesses within this range are obtained if the substrate is maintained in the above-described solution under the above described conditions for about one to about 2 minutes.

EXAMPLE 1

A solution was prepared by adding 267 ml of stannous methane sulfonate to one liter of an aqueous solution containing 200 mls of a 70 percent concentrate of methane sulfonic acid. To this solution was added 0.1 grams of a heterocyclic additive, phenolphthalein (obtained from Fisher Scientific Co.), and 0.84 grams of a polyalkoxylated alkyl phenol, octylphenoxy(10)polyethoxy ethanol, that is commercially available under the tradename Triton X-100® from Union Carbide. The resulting solution was then used to plate a layer of tin on a copper substrate by placing the substrate on a rotating cylinder electrode by immersing the substrate in the solution equipped with a soluble pure tin electrode as the anode. Current was then provided to the solution in a pulsed manner. The pulses of current were such that the current density was set at 65 ASF, and the pulse on-time was 50 μs with a duty cycle of about 28 percent. The plating solution was maintained under these conditions for a total time of about 1.2 minutes. The solution was maintained at a temperature of about 55° C. during the plating process.

The substrate was removed from the solution and the thickness of the tin plate was measured to be about 3 μm. The microstructure of the tin plate was photographed using scanning electron microscopy (SEM) and the photograph is provided in FIG. 1. Whiskers are less likely to form from a material with the microstructure in FIG. 1 because there is less internal stress in this microstructure than in a material with a microstructure in which the grains are less well-polygonized. A well-polygonized grain structure is evident from FIG. 1 because adjacent grain boundaries share a straight boundary and two adjacent grain boundaries of a single grain intersect at an angle of about 120° C. As evidence by the following example, this type of grain structure does not result when other processes are used to electroplate tin onto a metal substrate.

Also, the fact that the well-polygonized grain structure illustrated in FIG. 1 is stable is further indication that the microstructure has low stress. The structure is stable because the energy state of the deposit is close to the ground state. In other words, the activation energy required for the surface morphology to change is high.

EXAMPLE 2

A solution was prepared by adding stannous methanesulfonate (267 ml) to an aqueous solution of methane sulfonic acid (200 ml of a 70 percent solution of acid diluted to one liter with water). To this solution was added a heterocyclic additive, phenolphthalein (0.1 g) and Triton X-100® (0.8 g).

Figure 2:
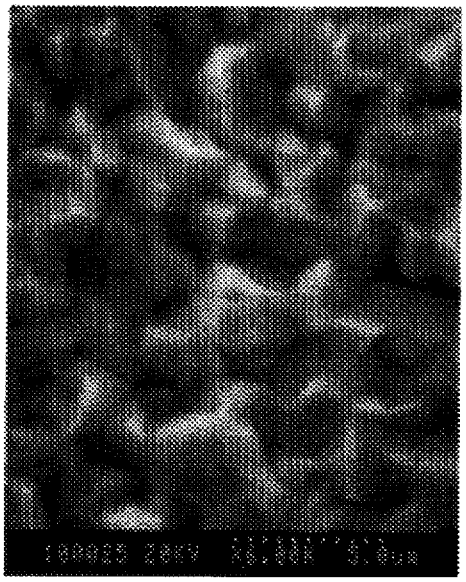
FIGS. 2 and 3 are photographs of the microstructure of a tin plate formed using prior art pulse plating conditions.

A copper metal substrate was then placed on a rotating cylinder electrode and placed in the solution. A soluble pure tin anode was also placed in the solution. Current with an average current density of 18 ASF, a pulse on time of 60 seconds and a pulse off time of 5 seconds was introduced into the plating solution over 4 minutes. Consequently, a duty cycle of ninety-two percent was used. The solution temperature was maintained at 20° C. The resulting tin plate had a thickness of about 3 μm. A photograph (at 6K magnification) of the microstructure of the resulting tin plate is provided in FIG. 2.

Figure 3:
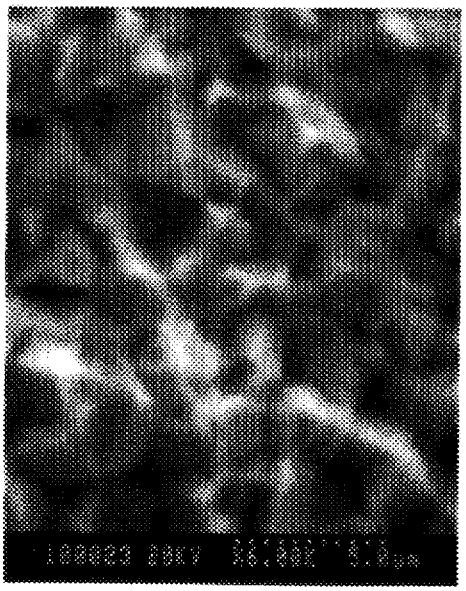

The process was repeated using the solution described above. The pulse conditions remained the same except the pulse was reversed for 5 seconds. A photograph (at 6K magnification) of the microstructure of the resulting tin plate is provided in FIG. 3.

EXAMPLE 3

A solution was prepared by adding stannous methanesulfonate (667 ml) to an aqueous solution of methane sulfonic acid (52 ml of a 70 percent solution of acid diluted to one liter with water). To this solution was added a heterocyclic additive, phenolphthalein (0.1 g) and Triton X-100® (0.8 g).

Figure 4:
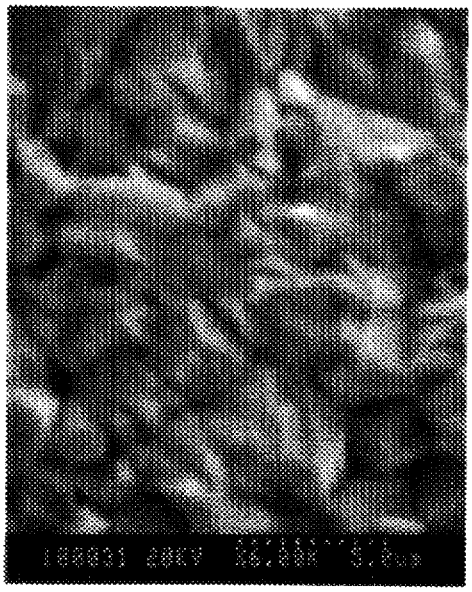
FIGS. 4 and 5 are photographs of the microstructure of a tin plate formed using prior art pulse plating conditions.

A copper metal substrate was then placed on a rotating cylinder electrode and placed in the solution. A soluble pure tin anode was also placed in the solution. Current with an average current density of 18 ASF, a pulse on time of 60 seconds and a pulse off time of 5 seconds was introduced into the plating solution over 4 minutes (duty cycle of ninety-two percent). The solution temperature was maintained at 20° C. The resulting tin plate had a thickness of about 3 μm. A photograph (at 6K magnification) of the microstructure of the resulting tin plate is provided in FIG. 4.

Figure 5:
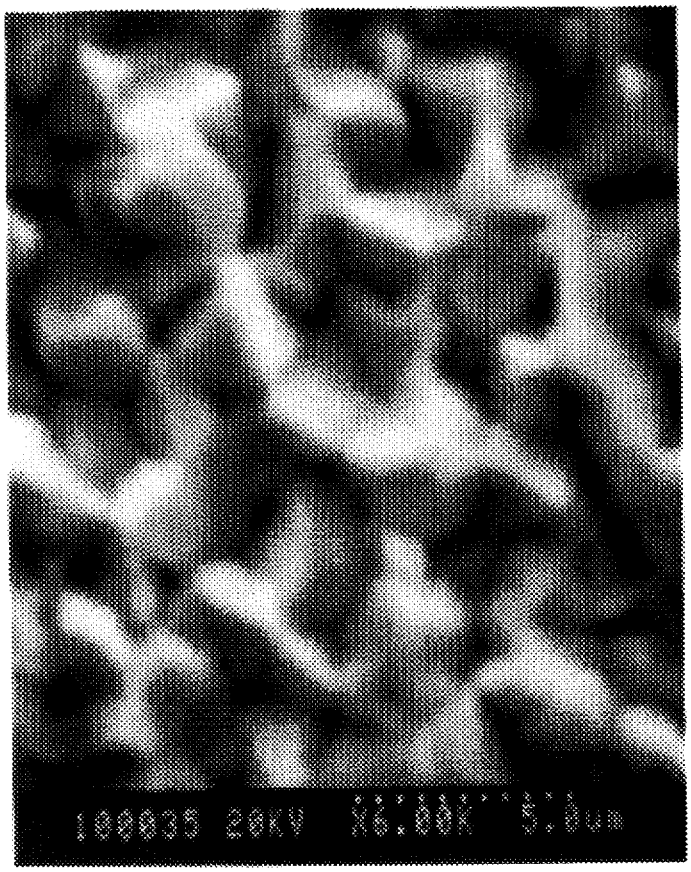

The process was repeated using the solution described above. The pulse conditions remained the same except the pulse was reversed for 5 seconds. A photograph (at 6K magnification) of the microstructure of the resulting tin plate is provided in FIG. 5.

FIGS. 2–5 demonstrate that the well-polygonized grain structure that results from the process of the present invention is not obtained when prior art pulse plating conditions are used. The well-polygonized grain structure that is obtained using the plating conditions of the present invention is illustrated in FIG. 1. The relatively straight boundaries between grains in FIG. 1 are in stark contrast to the much more irregular grain boundaries that are found in FIGS. 2–5.

What is claimed is:

1. A process for electroplating tin or tin alloy onto a metal substrate comprising:

placing a metal substrate in an aqueous plating bath comprising a stannous sulfonate selected from the group consisting of stannous alkyl sulfonate and stannous alkoyl sulfonate, a sulfonic acid selected from the group consisting of alkyl sulfonic acid or alkoyl sulfonic acid, and at least one organic additive that is an organic compound with at least one heterocyclic moiety, wherein the sulfonic acid in the bath has a concentration that is sufficient to provide the bath with a pH of about 1 or less and the organic additive in the bath has a concentration of about 0.08 g/l to about 0.8 g/l;

introducing a pulsed current into the bath under conditions sufficient to provide a tin or tin alloy coating on the substrate with well-polygonized grains having an average grain size of about 2 μm to about 8 μm.

2. The process of claim 1 wherein the stannous sulfonate in the bath has a concentration of about 20 g/l to about 110 g/l.

3. The process of claim 2 wherein the concentration of sulfonic acid in the bath is about 100 ml/l to about 250 ml/l.

4. The process of claim 1 wherein the heterocyclic moiety-containing additive further comprises an aromatic moiety that is bound to the heterocyclic moiety to form a moiety that contains at least two ring structures.

5. The process of claim 4 wherein the heterocyclic moiety-containing additive is selected from the group consisting of phenolphthalein and thymolphthalein.

6. The process of claim 1 wherein the bath further comprises a second additive wherein the second additive is a polyether.

7. The process of claim 6 wherein the second additive in the bath has a concentration of about 0.5 g/l to about 4 g/l.

8. The process of claim 7 wherein the polyether additive is selected from the group consisting of aliphatic polyethers, aromatic polyethers, and a mixture thereof.

9. The process of claim 1 wherein the current to the bath is cycled on and off in a pulsed manner and wherein the current provides an average current density during an on pulse of about 65 ASF to about 250 ASF and the pulsed cycle has a duty cycle of about twenty-five percent to about thirty percent.

10. The process of claim 9 wherein the on pulse has a duration of about 50 μs to about 500 μs.

* * * * *